US007433628B2

(12) United States Patent
Kweon et al.

(10) Patent No.: US 7,433,628 B2
(45) Date of Patent: Oct. 7, 2008

(54) PHOTORECEPTORS, DEVELOPING CARTRIDGE USING THE SAME, AND IMAGE FORMING APPARATUS USING THE SAME

(75) Inventors: Dae-seob Kweon, Suwon-si (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 407 days.

(21) Appl. No.: 11/408,083

(22) Filed: Apr. 21, 2006

(65) Prior Publication Data

US 2006/0239714 A1 Oct. 26, 2006

(30) Foreign Application Priority Data

Apr. 22, 2005 (KR) ..... 10-2005-0033547

(51) Int. Cl.
*G03G 15/00* (2006.01)

(52) U.S. Cl. ..... 399/117; 399/116; 399/159; 399/167

(58) Field of Classification Search ..... 399/116, 399/117, 159, 167
See application file for complete search history.

(56) References Cited

U.S. PATENT DOCUMENTS 5,444,516 A 8/1995 Michlin et al.
5,749,028 A 5/1998 Damji et al.
6,771,915 B2 * 8/2004 Cais et al. ..... 399/116
6,785,489 B2 * 8/2004 Anderson, II ..... 399/117
2004/0115548 A1 * 6/2004 Iizuka et al. ..... 430/69

FOREIGN PATENT DOCUMENTS

JP 2001-235967 8/2001
JP 2004-028299 1/2004

* cited by examiner

*Primary Examiner*—David M. Gray
*Assistant Examiner*—Ryan D Walsh
(74) *Attorney, Agent, or Firm*—Stein, McEwen & Bui, LLP

(57) ABSTRACT

A developing cartridge and an image forming apparatus having a photoreceptor drum are provided. The photoreceptor drum includes a pair of sleeves having outer diameter units inserted into the ends of a cylindrical drum on which a photoconductive material layer is formed, inner diameter units to which shafts are rotatably coupled, and at least two protrusion units separated from each other in a length direction of the shafts and contacting the shafts by protruding from the inner diameter units. Accordingly, the location tolerance and the assembly tolerance of the photoreceptor drum can be reduced by only modifying the shape of the sleeves, without adding additional parts. As a result, printing defects such as voids and unevenness can be advantageously prevented, since the developing nip and developing gap are formed very uniformly.

17 Claims, 4 Drawing Sheets

PHOTORECEPTORS, DEVELOPING CARTRIDGE USING THE SAME, AND IMAGE FORMING APPARATUS USING THE SAME

CROSS-REFERENCE TO RELATED PATENT APPLICATION

This application claims all benefits accruing under 35 U.S.C §119 from Korean Patent Application No. 10-2005-0033547, filed on Apr. 22, 2005, in the Korean Intellectual Property Office, the disclosure of which is incorporated by reference herein.

BACKGROUND OF THE INVENTION

1. Field of the Invention

The present invention relates to photoreceptor drums, and a developing cartridge and an image forming apparatus having the photoreceptor drums, and more particularly, to photoreceptor drums in which assembling tolerances are improved to maintain a uniform developing gap or a uniform developing nip, and a developing cartridge and an image forming apparatus having the photoreceptor drums.

2. Related Art

Electrophotographic image forming apparatuses, such as printers, photocopiers, facsimile machines and multi-functional products, are devices for printing an image on a recording medium, such as a paper, by an electrophotographic process. In such an image forming apparatus, an electrostatic latent image is formed on a photosensitive body, such as photoreceptor drum, and developed into a toner image by a developing roller. typically, a developing cartridge, which includes a developing roller and toner, is removably mounted in the main body of the image forming apparatus. The photoreceptor drum is either mounted in the developing cartridge or fixed to the main body of the image forming apparatus, according to the type of the image forming apparatus utilized.

Developing methods can be divided into two categories according to whether the developing roller contacts the photoreceptor drum. When the developing roller does contact the photoreceptor drum, a developing nip is formed, and a developing action is performed in the developing nip. When the developing roller does not contact the photoreceptor drum, a developing gap is formed, and a developing action is performed in the developing gap. To ensure satisfactory toner image development, the developing roller and the photoreceptor drum must be maintained in parallel and at a constant distance. Otherwise, the uniformity of the developing nip and the developing gap can be reduced, thereby degrading the image quality. If the developing roller and the photoreceptor drum are not correctly aligned, tone image failure may occur on the photoreceptor drum. That is, an image may be uneven or contain unprinted voids.

To avoid the above problems, the developing nip and the developing gap must be uniformly maintained in an axial direction of the photoreceptor drum and the developing roller. However, fine control of the developing nip and the developing gap is very difficult. The assembly tolerance of a plurality of parts for assembling a driving unit of the photoreceptor drum and a position determining unit must be strictly managed. When a pair of shafts support the ends of the photoreceptor drum, the shafts are must be axially aligned. A photoreceptor drum fixing device having two step shafts that support a photoreceptor drum has been disclosed, for example, in U.S. Pat. No. 5,749,028 entitled "Multi-size Photoreceptor Flange Bearing" and U.S. Pat. No. 5,444,546 entitled "Photoreceptor Drum Axle Improvement".

The tolerance management of the shafts and the photoreceptor drums are particularly important. This is because the shaft rotates in contact with the photoreceptor drum. As the contact area between the shaft and the photoreceptor drum increases, the management of the manufacture and assembly tolerances becomes increasingly difficult. However, if the contact area is too small, the shaking of the shaft with respect to the sleeves of the photoreceptor drum may occur, and the photoreceptor drum may not stay in parallel to the developing roller.

To print a color image, four (4) developing cartridges including four different color toners, such as cyan "C", magenta "M", yellow "Y", and black "K", must be included. The number of photoreceptor drums may be increased from one (1) to four (4) according to the printing method utilized. In an image forming apparatus that prints a color image, the number of developing rollers and photoreceptor drums increases, thereby increasing the difficulty of maintaining a uniform developing nip and developing gap.

SUMMARY OF THE INVENTION

Various aspects and example embodiments of the present invention provide a photoreceptor drum that can improve a location tolerance and an assembly tolerance without adding additional parts, while ensuring the uniformity of a developing nip and a development gap, and a developing cartridge and an image forming apparatus having the photoreceptor drum.

Additional aspects and/or advantages of the invention will be set forth in part in the description which follows and, in part, will be obvious from the description, or may be learned by practice of the invention.

In accordance with an aspect of the present invention, a photoreceptor drum is provided for use in an image forming apparatus, in which the ends of the photoreceptor drum are supported by a pair of shafts. Such a photoreceptor drum comprises a cylindrical drum on which a photoconductive material layer is formed; and a pair of sleeves having outer diameter units inserted into the ends of the cylindrical drum, inner diameter units to which the shafts are rotatably coupled, and at least two protrusion units separated from each other in a length direction of the shafts and contacting the shafts by protruding from the inner diameter units.

In accordance with another aspect of the present invention, a developing cartridge is provided for use in an image forming apparatus, comprising a developing roller; a photoreceptor drum facing the developing roller; and a pair of shafts that rotatably support the ends of the photoreceptor drum. Such a photoreceptor drum comprises: a cylindrical drum on which a photoconductive material layer is formed; and a pair of sleeves having outer diameter units inserted into the ends of the cylindrical drum, inner diameter units to which the shafts are rotatably coupled, and at least two protrusion units separated from each other in a length direction of the shafts and contacting the shafts by protruding from the inner diameter units.

According to an aspect to the present invention, the sleeves are formed of a synthetic resin using an injection mold, and the protrusion of the protrusion units is 0.03-0.05 mm.

In accordance with yet another aspect of the present invention, there is provided an image forming apparatus comprising: an image forming apparatus main body that prints an image using an electrophotographic method; a photoreceptor drum mounted on the image forming apparatus main body; and a pair of shafts that rotatably support the ends of the photoreceptor drum, wherein the photoreceptor drum comprises: a cylindrical drum on which a photoconductive material layer is formed; and a pair of sleeves having outer diameter units inserted into the ends of the cylindrical drum, inner diameter units to which the shafts are rotatably coupled, and at least two protrusion units separated from each other in a length direction of the shafts and contacting the shafts by protruding from the inner diameter units.

In accordance with yet another aspect of the present invention, an image forming apparatus is provided with a developing roller; a photoreceptor drum arranged in parallel with the developing roller, and having distal ends supported by a pair of shafts; and a pair of sleeves interposed between the photoreceptor drum and the shafts to support the photoreceptor drum in an axial direction, wherein each sleeve is provided with an outer perimeter surface inserted into the distal ends of the cylindrical drum, an inner perimeter surface rotatably coupled to the respective shaft, and at least two protrusions extending from the inner perimeter surface to form contact points with respect to the respective shaft; and wherein the protrusions are spaced apart to secure the respective shaft supporting the photoreceptor drum from shaking during an image formation, while maintaining a uniform develop nip when the developing roller contacts the photoreceptor drum or a uniform developing gap when the developing roller is separated from the photoreceptor drum.

In addition to the example embodiments and aspects as described above, further aspects and embodiments of the present invention will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
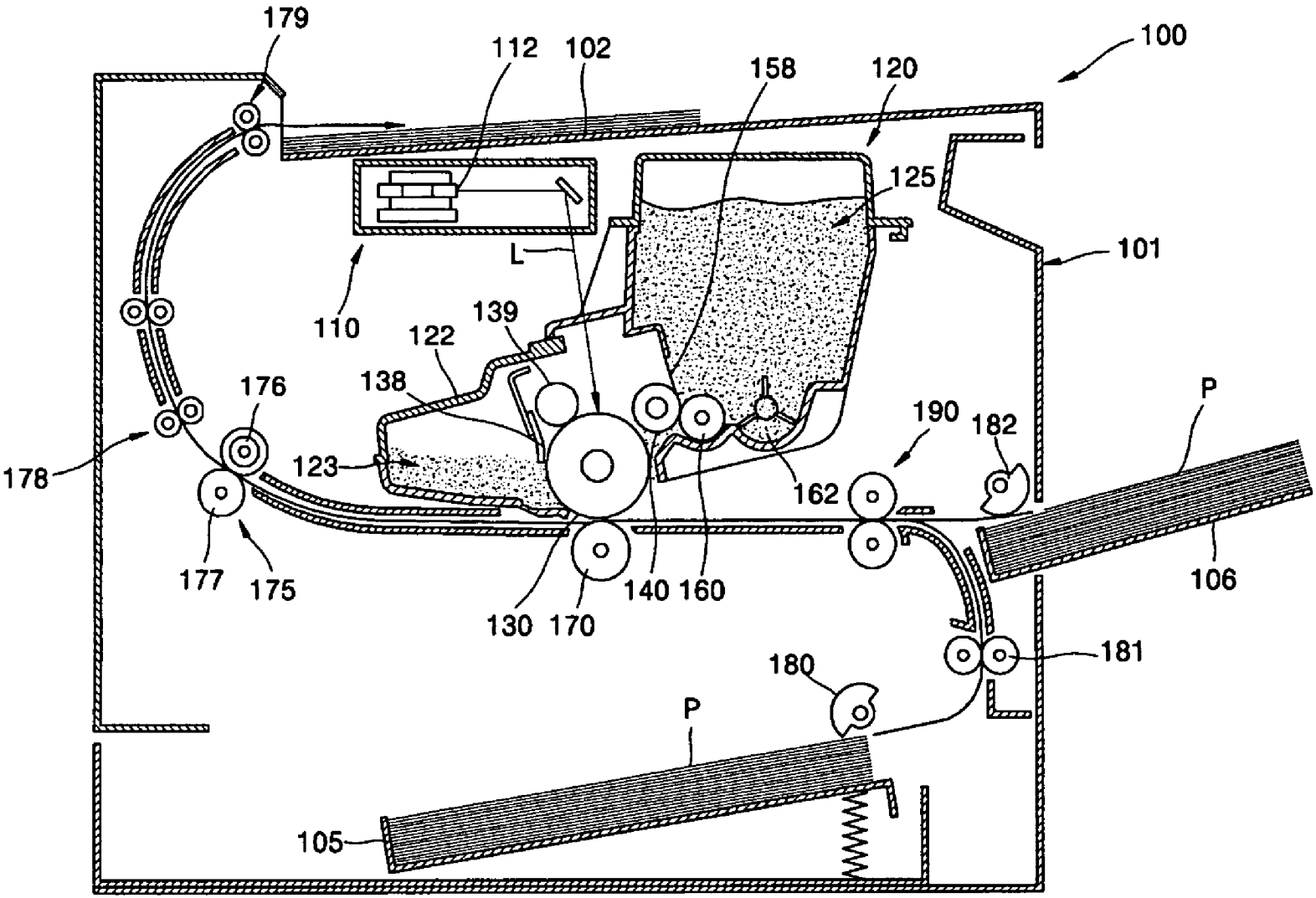
FIG. 1 is a lateral cross-sectional view of an example image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
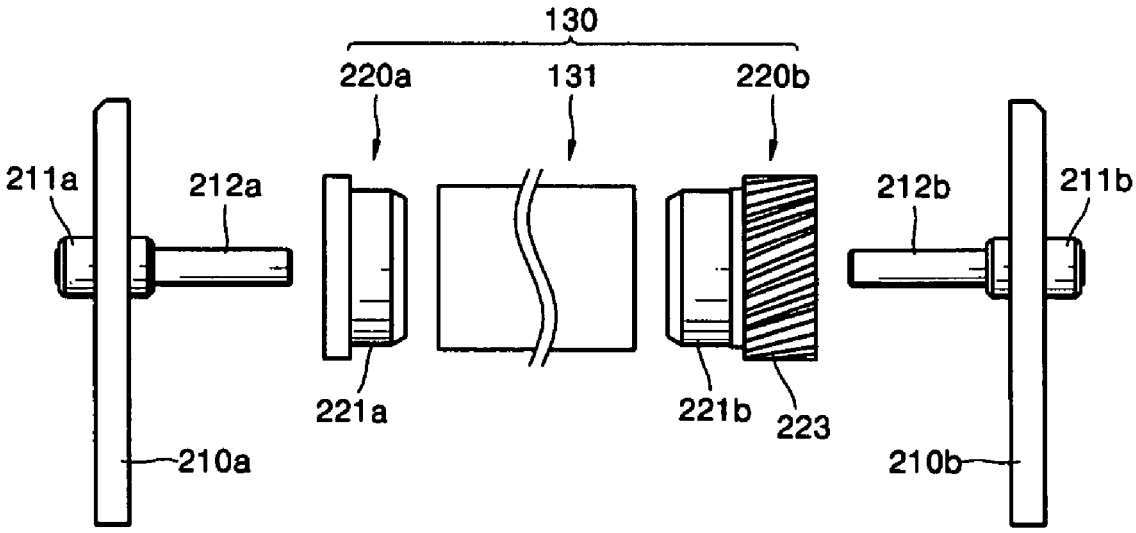
FIG. 4 is an exploded view of a photoreceptor drum, shafts, and sleeves according to an embodiment of the present invention.

FIG. 1 is a lateral cross-sectional view of an image forming apparatus according to an embodiment of the present invention. As shown in FIG. 1, the image forming apparatus 100 comprises a main body 101 that forms an image on a recording medium, such as paper, using an electrophotographic method, a photoreceptor drum 130 located in the main body 101, and a pair of shafts 212*a* and 212*b* (as shown in FIG. 4) that support the ends of the photoreceptor drum 130. The image forming apparatus main body 101 includes a laser scanning unit 110; a developing cartridge 120; a fixing unit 175; a de-curl unit 178; a pickup assembly including a first pickup roller 180 to pickup an individual sheet of paper (P) from a first paper cassette 105, feed rollers 181 to feed the individual sheet of paper (P) into a main portion for image formation, a second pickup roller 182 to pickup an individual sheet of paper (P) from a second paper cassette 106 into the main portion for image formation; and a paper aligning unit 190 to align the individual sheet of paper (P) picked up from either the first paper cassette 105 or the second paper cassette 106 for image formation.

The laser scanning unit 110 forms an electrostatic latent image on the photoreceptor drum 130 by radiating a laser beam corresponding to image information onto the photoreceptor drum 130. The laser scanning unit 110 includes a laser source (not shown) and a beam deflector 112 that deflects a laser beam from a laser source.

The developing cartridge 120 is removably mounted in the main body 101. The developing cartridge 120 includes a developing roller 140, a photoreceptor drum 130 facing the developing roller 140, and a pair of shafts 212*a* and 212*b* that support the ends of the photoreceptor drum 130 to enable the photoreceptor drum 130 to rotate, as shown in FIG. 4. A developing cartridge housing 122 constitutes the exterior of the developing cartridge 120. The photoreceptor drum 130, an electric charge roller 139, a cleaning member 138, the developing roller 140, a toner layer control member 158, a supply roller 160, and an agitator 162 are located in the developing cartridge housing 122. The developing cartridge 120 can be replaced when the toner stored in a toner container 125 is exhausted.

The photoreceptor drum 130 rotates to expose a portion of its outer circumference. A photoconductive material layer is coated on a surface of a cylindrical drum 131 using a deposition method. The photoreceptor drum 130 is charged by the electric charge roller 139, and an electrostatic latent image corresponding to an image to be printed is formed on the photoreceptor drum 130 by the laser beam (L) radiated from the laser scanning unit 110.

The developing roller 140 contains toner in a solid powder state, and the electrostatic latent image is developed into a toner image by supplying the toner to the electrostatic latent image formed on the photoreceptor drum 130. A developing bias voltage for supplying the toner to the photoreceptor drum 130 is applied to the developing roller 140.

The supply roller 160 supplies the toner to adhere to the developing roller 140. The agitator 162 agitates the toner in the toner container 125 to prevent hardening, and supplies the toner to the supply roller 160. The toner layer control member 158 controls the thickness of the toner adhering to the developing roller 140.

The cleaning member 138 is mounted in the developing cartridge housing 122, and one end of the developing cartridge housing 122 contacts the photoreceptor drum 130 to scrape the remaining toner from the photoreceptor drum 130 after transferring an image.

A transfer roller 170 faces the photoreceptor drum 130, and a transferring bias voltage of opposite polarity to the toner image is applied to the transfer roller 170 to transfer the toner image from the photoreceptor drum 130 to each individual sheet of paper (P).

The fixing unit 175 includes a heating roller 176 and a press roller 177 facing the heating roller 176, and fixes the toner image on the individual sheet of paper (P) by applying heat and pressure to the toner image.

The de-curl unit 178 removes curls generated by the heat of the fixing unit 175 from the paper (P). A paper discharge roller 179 then discharges the paper (P) on which the toner image is fixed to the outside. The discharged paper (P) is stacked on a discharge paper deck 102.

The feeding path of the individual sheet of paper (P) can be described as follows. The image forming apparatus 100 includes first and second paper supply cassettes 105 and 106 on which the paper (P) is stacked. Each of the pick-up rollers 180 and 182 picks up the paper (P) sheet by sheet from the first and second paper supply cassettes 105 and 106. A feed roller 181 supplies a feeding force to feed the paper (P) toward a paper aligning unit 190. The paper aligning unit 190 aligns the paper (P) to transfer the toner image on a desired location of the paper (P) before the paper (P) passes through a transfer gap between the photoreceptor drum 130 and the transfer roller 170.

Figure 2:
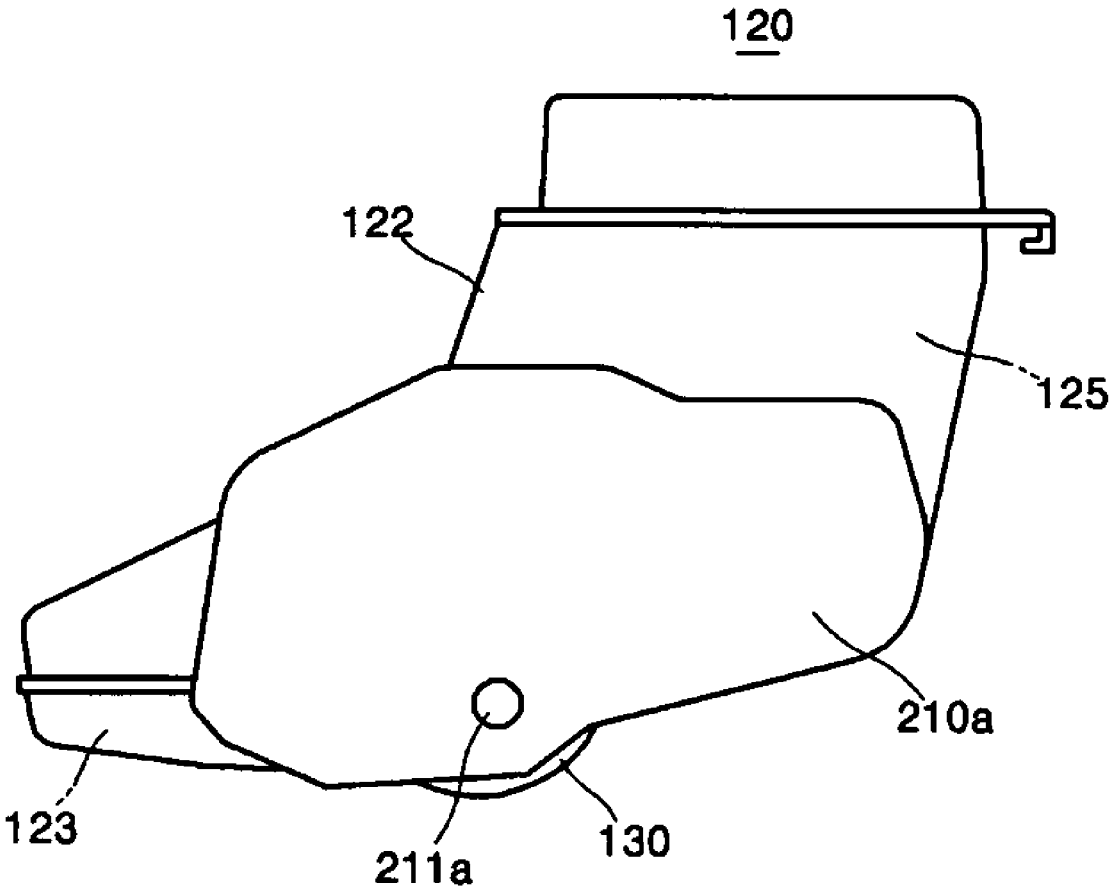
FIG. 2 is a lateral view of an example developing cartridge according to an embodiment of the present invention.

FIG. 2 is a lateral view of an example developing cartridge according to an embodiment of the present invention. As shown in FIG. 2, the developing cartridge 120 includes a housing 122 which includes a waste toner container 123 to store waste toner separated from the photoreceptor drum 130 by the cleaning member 138, and the toner container 125 to store toner used as a developing agent.

As an example, the developing cartridge housing 122 includes a waste toner container frame (not shown) that constitutes an outer case of the waste toner container 123, and a toner container frame (not shown) that constitutes an outer case of the toner container 125. The toner container frame supports the developing roller 140, the supply roller 160, the agitator 162, and the toner layer control member 158. The waste toner container frame supports the discharge roller 139 and the cleaning member 138.

Lateral plates 210*a* and 210*b* support the waste toner container 123 and the toner container 125 at both sides of the developing cartridge housing 122. As an example, in a swing type developing cartridge, a developing nip and a developing gap can be uniformly maintained by rotatably coupling the toner container frame to a fixing hinge (not shown) of the lateral plates 210*a* and 210*b*.

The photoreceptor drum 130 must be mounted in the correct position, since the photoreceptor drum 130 takes the role of forming an image by facing the transfer roller 170 and the developing roller 140. As an example, when the photoreceptor drum 130 is mounted in the developing cartridge housing 122, the lateral plates 210*a* and 210*b*, which are coupled to the image forming apparatus main body 101, control the mounting position of the photoreceptor drum 130. Fixing guides 211*a* and 211*b* formed on the lateral plates 210*a* and 210*b* guide the developing cartridge housing 122 for mounting in the image forming apparatus main body 101.

Figure 3:
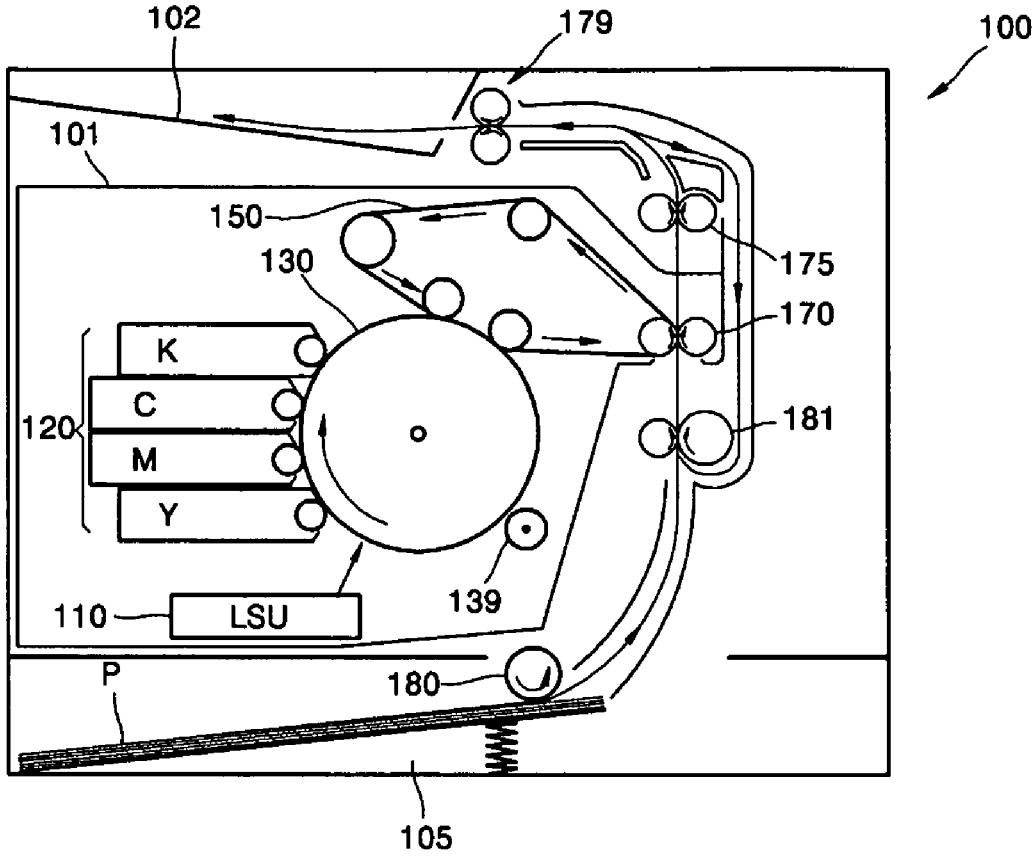
FIG. 3 is a lateral cross-sectional view of an example developing cartridge and an example image forming apparatus according to another embodiment of the present invention.

The developing cartridge 120 and the image forming apparatus 100 according to the present invention are not limited to the monochrome laser printer depicted in FIGS. 1 and 2. FIG. 3 is a lateral cross-sectional view of a developing cartridge and an image forming apparatus according to another embodiment of the present invention. Like reference numerals denote like elements, and the description thereof will not be repeated.

However, a plurality of developing cartridges 120 are required to print a color image using an electrophotographic method. As a result, multiple developing cartridges may be utilized. For example, as shown in FIG. 3, a multi-pass type image forming apparatus includes one photoreceptor drum 130 and four developing cartridges 120. As an example, the photoreceptor drum 130 is mounted on the image forming apparatus main body 101 separately from the developing cartridges 120. Although it is not shown, a single-pass type image forming apparatus includes four developing cartridges and four photoreceptor drums, and a 2-pass type image forming apparatus includes two units, each including two developing cartridges and one photoreceptor drum. In the monochrome image forming apparatus or the color image forming apparatus of the aforementioned embodiments, the photoreceptor drum 130 is mounted on an inner side of the developing cartridge 120 or the image forming apparatus main body 101 directly. A developing nip is formed when the developing roller 140 contacts the photoreceptor drum 130, or a developing gap is formed when the developing roller 140 is separated from the photoreceptor drum 130. The developing nip or the developing gap must be kept uniform in axial directions of the developing roller 140 and the photoreceptor drum 130. As the number of photoreceptor drums 130, developing rollers 140, or developing cartridges 120 increases, it is more important to maintain a uniform developing nip or developing gap.

FIG. 4 is an exploded perspective view of the photoreceptor drum 130, shafts 212*a* and 212*b*, and sleeves 220*a* and 220*b* according to an embodiment of the present invention. As an example, when the photoreceptor drum 130 is included in the developing cartridge 20, the photoreceptor drum 130 is fixed at a predetermined position in the image forming apparatus main body 101 while the developing cartridge 120 is being assembled in the image forming apparatus main body 101.

Shafts 212*a* and 212*b* can be coupled to the lateral plates 210*a* and 210*b* using additional coupling members, or can be injection molded in one body with the lateral plates 210*a* and 210*b*. Both end parts of the photoreceptor drum 130 are rotatably supported by the shafts 212*a* and 212*b*. The photoreceptor drum 130 includes a cylindrical drum 131 on which a photoconductive material layer is formed. Sleeves 220*a* and 220*b* are interposed between the photoreceptor drum 130 and the shafts 212*a* and 212*b*. To support the whole photoreceptor drum 130 in an axial direction of the photoreceptor drum 130, two sleeves 220*a* and 220*b*, one for each end part, are provided.

The two sleeves 220*a* and 220*b* include outer diameter units (e.g., outer surfaces) 221*a* and 221*b* to which the photoreceptor drum 130 is coupled, or fitted therein, and inner diameter unit (e.g., inner surface) 330*b* into which shafts 212*a* and 212*b* are inserted therein. The cylindrical drum 131 is coupled to the outer diameter units 221*a* and 221*b*. At least one sleeve, such as sleeve 220*b*, includes a sleeve gear 223 used to rotate the photoreceptor drum 130. The photoreceptor drum 130 receives an eccentric force with respect to the shafts 212*a* and 212*b* since the photoreceptor drum 130 is driven from one side.

The assembly tolerances of the lateral plates 210*a* and 210*b*, the shafts 212*a* and 212*b*, the photoreceptor drum 130, and the developing roller 140 must be controlled. The two shafts 212*a* and 212*b* and the developing roller 140 are mounted on a predetermined location of the lateral plates 210*a* and 210*b*. At this time, the two shafts 212*a* and 212*b* and the developing roller 140 must meet the tolerance limit of perpendicularity with respect to the lateral plates 210*a* and 210*b* and the tolerance limit of parallelism, and the two shafts 212*a* and 212*b* must meet the tolerance limit of concentricity among themselves. The photoreceptor drum 130 and the shafts 212*a* and 212*b* are coupled as follows.

Figure 5:
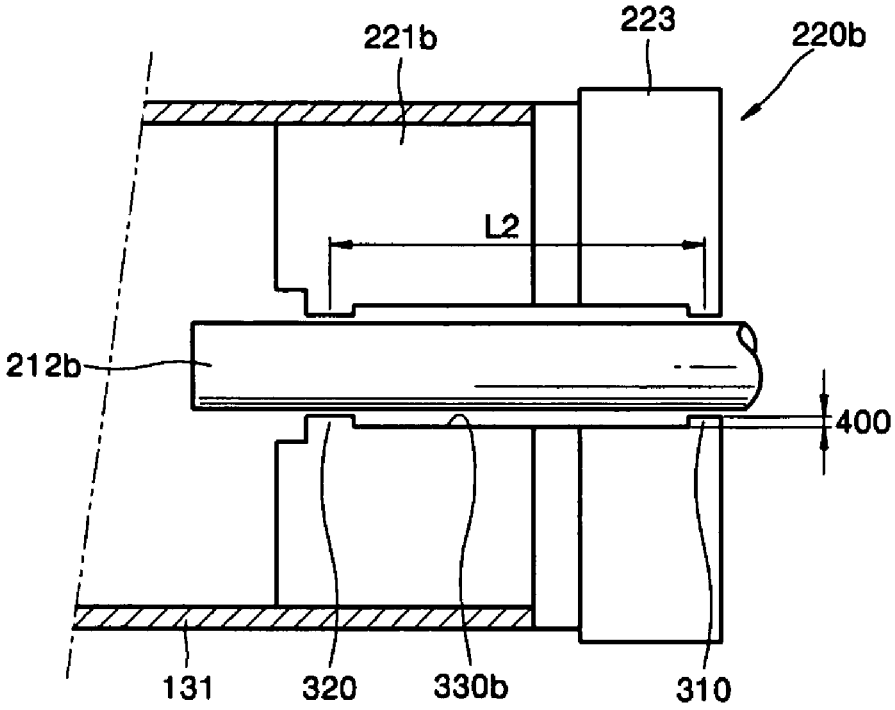
FIG. 5 is a lateral cross-sectional view of an example protrusion unit according to an embodiment of the present invention.

FIG. 5 is a lateral cross-sectional view of example protrusion units 310 and 320 used in a respective sleeve according to an embodiment of the present invention. Each of the shafts 212*a* and 212*b* and the sleeves 220*a* and 220*b* are located at one end of the photoreceptor drum 130. Both end parts of the inner diameter units (e.g., inner surfaces) 330*b* of, for example, the sleeve 220*b* contact the outer circumference of the shaft 212*b*, and include protrusion units 310 and 320 arranged separated from each other by the distance indicated by reference numeral L2. The shaft 212*b* contacts the protrusion units 310 and 320. Each end of the photoreceptor drum 130 is supported by two points with respect to the shafts 212*a* and 212*b*. As a result, the entire length of the photoreceptor drum 130 is supported by four points in an axial direction. The dimensional tolerance over the whole length of the reference numeral L2 is not controlled, but only the dimensional tolerance over the protrusion units 310 and 320 is partially controlled. Even though the perpendicularity of the two shafts 212*a* and 212*b* with respect to the lateral plates 210*a* and 210*b* may deviate, the assembly location and the assembly angle of the photoreceptor drum 130 are corrected to some degree by the four supporting points.

Figure 6:
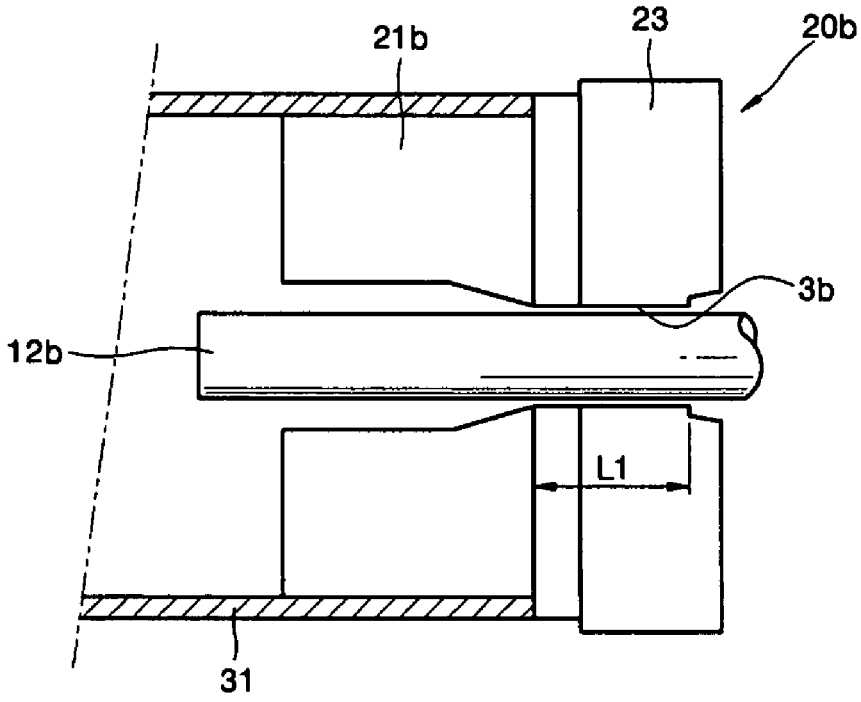
FIG. 6 is a lateral cross-sectional view of a typical photoreceptor drum fixing device.

FIG. 6 is a lateral cross-sectional view of a typical photoreceptor drum 31 fixing device. The shafts 12*a* and 12*b* and sleeves 20*a* and 20*b* are provided at the ends of the typical photoreceptor drum 31 fixing device. The shaft 12*b* contacts the sleeve 20*b* over the length indicated by reference numeral L1. Therefore, the dimensional tolerance over the whole length indicated by reference numeral L1 must be correctly controlled. As a result, the assembly tolerance of the photoreceptor drum 31 is affected greatly by wearing of the inner diameter units 3*a* and 3*b*, the dimensional tolerance of the inner diameter units 3*a* and 3*b*, and the perpendicularity of the shafts 12*a* and 12*b* with respect to the lateral plates 210*a* and 210*b*.

In accordance with an embodiment of the present invention, as shown, for example, in FIG. 4 and FIG. 5, however, the actual contact area between the shafts 212*a* and 212*b* and the inner diameter units 330*a* and 330*b* is not increased, but the protrusion units 310 and 320 are separated as far as possible from each other and the outer circumferences of the shafts 212*a* and 212*b* contact locally at two points. If the dimensions of the protrusion units 310 and 320 are correctly controlled, the shaft shaking of the photoreceptor drum 130 may not occur, and the photoreceptor drum 130 is kept parallel to the developing roller 140. The shaft shaking means the shaking of the shafts 212*a* and 121*b* with respect to the sleeves 220*a* and 220*b*. The assembly tolerance of the shafts 212*a* and 212*b* and the photoreceptor drum 130 can be maintained if the tolerances of the protrusion units 310 and 320 are controlled. The correct location and the assembly tolerance of the photoreceptor drum 130 are controlled by the shape of the sleeves 220*a* and 220*b*, without adding additional parts.

The sleeves 220*a* and 220*b* are injection molded using a synthetic resin. As an example, when the protrusion units 310 and 320 are injection molded, the sleeves 220*a* and 220*b* may be difficult to remove from the mold. As an example, the sleeves 220*a* and 220*b* can be formed of LS1250 polycarbonate. A smaller protrusion 400 (as shown in FIG. 5) of the protrusion units 310 and 320 is advantageous for injection molding, but the protrusion 400 of the protrusion units 310 and 320 must be greater than a certain dimension to meet the purpose of the present invention. The protrusion 400 of the protrusion units 310 and 320 may be 0.03-0.05 mm. This can not be seen by the naked eye, but the actual contact points between the shafts 212*a* and 212*b* and the inner diameter units 330*a* and 330*b* can be limited to the protrusion units 310 and 320, and such a small protrusion 400 does not cause a problem in the injection molding process.

When the lateral plates 210*a* and 210*b*, the shafts 212*a* and 212*b*, the sleeves 220*a* and 220*b*, and the photoreceptor drum 130 are assembled, the inner diameter units 330*a* and 330*b* and the shafts 212*a* and 212*b* where a large assembly tolerance occurs are assembled as aforementioned, a uniform developing nip or developing gap can be formed. Accordingly, printing defects, such as a voids or unevenness, can be advantageously reduced.

As described above, in a photoreceptor drum and a developing cartridge and an image forming apparatus having the photoreceptor drum, according to the present invention, the tolerance is controlled more easily by reducing the contact area between the shafts and the photoreceptor drum and separating the contact points between the shaft and the inner surface of the sleeve as far as possible from each other. Therefore, the shaft shaking of the photoreceptor drum is prevented and the photoreceptor drum is kept parallel to the developing roller. Accordingly, printing defects such as voids or unevenness can be reduced, since the developing nip or developing gap is uniform in axial directions of the developing roller and the photoreceptor drum.

While the present invention has been particularly shown and described with reference to exemplary embodiments thereof, it will be understood by those of ordinary skill in the art that various changes in form and details may be made therein without departing from the spirit and scope of the present invention. For example, components of an image forming apparatus, as shown in FIG. 1 and 3, can be arranged differently as long as the actual contact area between the shafts and the inner surface of the sleeves is kept to a minimal and the protrusions from the inner surface of the sleeves are separate as far as possible from each other to maintain stability and prevent the photoreceptor drum from being shaken. In addition, the protrusion units, as shown in FIG. 5, can be arranged at any given distance on the inner surface of the sleeves as long as stability and uniformity can be maintained. Likewise, on the inner surface of each sleeve, there may be multiple protrusions used to maintain a uniform developing nip or developing gap. Accordingly, it is intended, therefore, that the present invention not be limited to the various example embodiments disclosed, but that the present invention includes all embodiments falling within the scope of the appended claims.

What is claimed is:

1. A photoreceptor drum for use in an image forming apparatus, in which distal ends of the photoreceptor drum are supported by a pair of shafts, the photoreceptor drum comprising:

a cylindrical drum on which a photoconductive material layer is formed; and a pair of sleeves having outer diameter units inserted into the ends of the cylindrical drum, inner diameter units to which the shafts are rotatably coupled, and at least two protrusion units separated from each other in a length direction of the shafts and contacting the shafts by protruding from the inner diameter units.

2. The photoreceptor drum as claimed in claim 1, wherein the sleeves are formed of a synthetic resin using an injection mold, and the protrusion of the protrusion units is 0.03-0.05 mm.

3. A developing cartridge for use in an image forming apparatus, comprising: a developing roller; a photoreceptor drum facing the developing roller; and a pair of shafts that rotatably support the ends of the photoreceptor drum, wherein the photoreceptor drum comprises:

a cylindrical drum on which a photoconductive material layer is formed; and a pair of sleeves having outer diameter units inserted into the ends of the cylindrical drum, inner diameter units to which the shafts are rotatably coupled, and at least two protrusion units separated from each other in a length direction of the shafts and contacting the shafts by protruding from the inner diameter units.

4. The developing cartridge as claimed in claim 3, wherein the sleeves are formed of a synthetic resin using an injection mold, and the protrusion of the protrusion units is 0.03-0.05 mm.

5. An image forming apparatus comprising:

a main body arranged to print an image on a printable medium using an electrophotographic method;

a photoreceptor drum mounted on the main body; and a pair of shafts that rotatably support the ends of the photoreceptor drum, wherein the photoreceptor drum comprises:

a cylindrical drum on which a photoconductive material layer is formed; and a pair of sleeves having outer diameter units inserted into the ends of the cylindrical drum, inner diameter units to which the shafts are rotatably coupled, and at least two protrusion units separated from each other in a length direction of the shafts and contacting the shafts by protruding from the inner diameter units.

6. The image forming apparatus as claimed in claim 5, wherein the sleeves are formed of a synthetic resin using an injection mold, and the protrusion of the protrusion units is 0.03-0.05 mm.

7. The image forming apparatus as claimed in claim 5, further comprising at least one developing cartridge which is mounted on the main body and having a developing roller facing the photoreceptor drum.

8. The image forming apparatus as claimed in claim 7, wherein a developing nip is formed when the photoreceptor drum contacts the developing roller, or a developing gap is formed when the photoreceptor drum is separated from the developing roller.

9. The photoreceptor drum claimed in claim 1, wherein one of the sleeves includes a sleeve gear arranged to rotate the photoreceptor drum during an image formation, and the sleeves are interposed between the photoreceptor drum and the shafts to support the photoreceptor drum in an axial direction.

10. The developing cartridge as claimed in claim 3, wherein one of the sleeves includes a sleeve gear arranged to rotate the photoreceptor drum during an image formation, and the sleeves are interposed between the photoreceptor drum and the shafts to support the photoreceptor drum in an axial direction of the photoreceptor drum.

11. The developing cartridge as claimed in claim 3, wherein the shafts are coupled to lateral plates mounted on both sides of the developing cartridge to support the developing roller and maintain a uniform develop nip when the developing roller contacts the photoreceptor drum, or a uniform developing gap when the developing roller is separated from the photoreceptor drum.

12. The image forming apparatus as claimed in claim 5, wherein one of the sleeves includes a sleeve gear arranged to rotate the photoreceptor drum during an image formation, and the sleeves are interposed between the photoreceptor drum and the shafts to support the photoreceptor drum in an axial direction.

13. The image forming apparatus as claimed in claim 5, wherein the shafts are coupled to lateral plates mounted on both sides of the developing cartridge to support the developing roller and maintain a uniform develop nip when the developing roller contacts the photoreceptor drum, or a uniform developing gap when the developing roller is separated from the photoreceptor drum.

14. An image forming apparatus comprising:

a developing roller;

a photoreceptor drum arranged in parallel with the developing roller, and having distal ends supported by a pair of shafts; and a pair of sleeves interposed between the photoreceptor drum and the shafts to support the photoreceptor drum in an axial direction, wherein each sleeve is provided with an outer perimeter surface inserted into the distal ends of the cylindrical drum, an inner perimeter surface rotatably coupled to the respective shaft, and at least two protrusions extending from the inner perimeter surface to form contact points with respect to the respective shaft; and wherein the protrusions are spaced apart to secure the respective shaft supporting the photoreceptor drum from shaking during an image formation, while maintaining a uniform develop nip when the developing roller contacts the photoreceptor drum or a uniform developing gap when the developing roller is separated from the photoreceptor drum.

15. The image forming apparatus as claimed in claim 14, wherein the sleeves are formed of a synthetic resin using an injection mold, and the protrusions exhibit a height of 0.03-0.05 mm.

16. The image forming apparatus as claimed in claim 14, wherein one of the sleeves includes a sleeve gear arranged to rotate the photoreceptor drum during an image formation.

17. The image forming apparatus as claimed in claim 14, wherein the photoreceptor drum is mounted in a developing cartridge, and the shafts are coupled to lateral plates mounted on both sides of the developing cartridge to support the developing roller and maintain a uniform develop nip when the developing roller contacts the photoreceptor drum, or a uniform developing gap when the developing roller is separated from the photoreceptor drum.

* * * * *